US005443640A

United States Patent [19]

Heyvaerts et al.

[11] Patent Number: 5,443,640

[45] Date of Patent: Aug. 22, 1995

[54] STATION FOR THE CONTROL OF AN ATOMIZED CURRENT

[75] Inventors: André L. Heyvaerts, Hemiksem, Belgium; Jan M. Leeuws, Mount Plaisant, S.C.

[73] Assignee: Agfa-Gevaert, N.V., Mortsel, Belgium

[21] Appl. No.: 94,179

[22] Filed: Oct. 1, 1993

[30] Foreign Application Priority Data

Feb. 4, 1991 [EP] European Pat. Off. ..... 91200202.9

[51] Int. Cl.[6] ..... B05B 7/06

[52] U.S. Cl. ..... 118/313; 118/315; 118/325; 427/421; 427/600; 239/338; 239/343; 239/432

[58] Field of Search ..... 427/421, 600; 239/338, 239/343, 432; 118/325, 313, 315

[56] References Cited

U.S. PATENT DOCUMENTS 4,218,533 8/1980 Fuchigami et al. ..... 430/512
5,173,325 12/1992 Knobbe et al. ..... 427/476

FOREIGN PATENT DOCUMENTS 0165695 12/1985 European Pat. Off. .
0405527 1/1991 European Pat. Off. .
8400906 3/1984 WIPO .

*Primary Examiner*—Shrive Beck
*Assistant Examiner*—David M. Maiorana
*Attorney, Agent, or Firm*—Breiner & Breiner

[57] ABSTRACT

A coating station for coating a thin layer of coating composition on a web which comprises a housing having an inlet connected to a source of pressurized air and provided with a plurality of atomizing means for the coating composition arranged in a row running parallel to the path of the web, and further having mutually diverging upper and lower wall means defining a space with a rectangular cross-section operative to decrease the velocity of the air current loaded with atomized coating composition, and converging upper and lower wall means causing an homogenizing of said loaded air current, and an elongate outlet port causing acceleration of said air current and application thereof onto said web.

5 Claims, 2 Drawing Sheets

STATION FOR THE CONTROL OF AN ATOMIZED CURRENT

FIELD OF THE INVENTION

This invention relates to a process for coating a photographic material and to a station for the control of an atomized current of coating composition.

Description of the Prior Art

Generally, a photographic material is produced by coating a support with a coating composition, such as a silver halide-gelatin emulsion and/or a coating solution for a non-light sensitive interlayer (to be referred to hereinafter generally as a "coating composition"), cooling the coating to set it and finally drying it. The general practice is to incorporate various additives in the coating composition during its preparation. Some types of additives, however, tend to react with gelatin or with other chemicals in the coating composition and will adversely affect the properties of the coating composition or of the coatings, the photographic characteristics of the photographic material and the physical properties of the coating layer obtained, such as swelling, adhesion, wettability, anti-static property etc. When such additives are used, the coating composition must be applied immediately after preparation so as to avoid such adverse effects. This imposes a restriction in the use of fast-acting additives. Furthermore, according to this practice, an additive the distribution of which should desirably be controlled in a particular area, for example a surface modifier such as anti-static agents, matting agents etc. which should desirably be distributed and concentrated near the surface of the coating, cannot be incorporated in such a manner so as to achieve the desired distribution.

It has been proposed to achieve the described objective by atomizing additives utilizing ultrasonic vibration and spraying the atomized additives onto a continuously moving support or onto a coating previously applied on the continuously moving support. The disadvantage of this process is that ultrasonic transducers have a limited life-time and should in principle be operated with demineralized water so as to avoid solid deposits in the long run. This technique is known from U.S. Pat. No. 4,218,533.

Further it is known to coat a paper support by making a fog from a coating slurry, carrying the fog by an air current and directing the fog thus carried to a nozzle that does not physically contact the substrate. This method is destined for coating paper, paper board and other such materials with various substances to change the colour, the surface structure or the like, but is unsuited for the uniform coating of thin layers as in the production of photographic material. It is disclosed in U.S. Pat. No. 4,944,960.

Finally, it is known to apply an electrically conductive layer to an insulating support by means of an atomizer which comprises an atomizing box, a guide tube having one open end of small diameter and the other open end of large diameter, a nozzle having an ejection outlet disposed in the atomizing box and directed from the one open end of small diameter to the other open end of large diameter respectively of the guide tube, an atomizing solution reservoir defined in the atomizing box and confronting the other open end of large diameter of the guide tube, extending from the other open end to the one open end thereof for returning the atomized solution from the atomizing solution reservoir to the one open end thereof.

This atomizer is disclosed in EP-A-405527, but it does not offer a sufficient control of the atomized solution for its application in photography.

SUMMARY OF THE INVENTION

Object of the Invention

An object of the invention is to provide a process for coating a photographic material, and more in particular a process permitting the incorporation of additives into a coating composition.

A particular object of the invention is to provide a process permitting the application of an extremely thin layer, such as an antistatic layer to the top surface of a photographic material, particularly during the manufacturing of such photographic material after the drying thereof.

A further object of the invention is to provide a station for the control of an atomized current of coating composition in a photographic coating process.

Statement of the Invention

In accordance with the present invention, a process for coating a photographic material, comprising atomizing a coating composition, carrying said atomized coating composition by an air current and applying said air current carrying said atomized coating composition to a continuously travelling support, is characterized by homogenizing and decelerating the velocity of the air current carrying the atomized coating composition on its way to the support thereby eliminating droplets of coating composition from the air current having a particle size beyond a certain maximum value so that they become no longer supported by the air current, and then accelerating the air current carrying the remaining atomized coating composition to such an extent that it is capable of penetrating the boundary layer of air entrained by the travelling support.

The coated composition can be cooled to set it prior to its drying, but said coated composition can also be dried without setting, depending on its wet layer thickness, its rheological properties, etc. Further, the applied coating can get dry without being subjected to any true drying step such as a treatment with heated and/or dried air, or by IR-radiation. Thus, in the case of extremely thin layers that are coated on a dry gelatinous base layer, the freshly coated layer can be sucked up almost instantly in the underlying layer. This can occur within seconds and no true drying station is required in such case.

The process of the present invention thus enables an additive to be incorporated in a photographic material to an amount which is so small that the atomized additive may be supplied at a stage in the manufacturing process in which a coating supplied to the support has dried already and in which the support is going to be wound up after such drying. When an antistatic layer is applied, the liquid additive used is instantly sucked in the dried, previous layer so that the coated support may start winding even less than 1 second after the application of the additive thereto.

Suitable embodiments of the process according to the present invention are as follows.

The homogenizing and deceleration of the velocity of the air current carrying the atomized coating composition occurs in two successive phases. This allows a better control of the size of the coating composition particles that must be eliminated from the carrying air current.

The air current carrying the atomized coating composition is accelerated between said two successive deceleration phases. This improves the homogenizing of the air current.

The process is adjusted so that droplets with a particle size larger than 40 μm are no longer supported by the air current.

The process is adjusted so that the velocity of the carrying air current is decreased to at most 0.25 m/s.

The atomized coating composition can be an additive to be incorporated in an already coated layer on the support.

The atomized coating composition can be an additive to be incorporated in a next layer on the support.

The interest of the present invention is situated particularly in the coating of photographic layers with a small wet layer thickness, i.e. smaller than approximately 4 μm. Such layers are e.g. subbing or primer layers applied on hydrophobic resin supports as disclosed for instance in U.S. Pat. No. 3,649,336, aqueous layers of hardening agents for gelatin and layers containing development nuclei applied in diffusion transfer reversal processing of photographic silver halide emulsion layer materials (ref. Photographic Silver Halide Diffusion Processing by André Rott and Edith Weyde—The Focal Press, London and New York, 1972).

The present invention also includes a station for control of an atomized current.

According to the invention, a station for the control of an atomized current of coating composition in a photographic coating process, comprises an inlet opening connected to a source of pressurized air, at least one atomizing means for the coating composition, wall means operative to decrease the velocity of the air current with the atomized coating composition and to cause the homogenization of said current, an opening in the bottom for carrying off droplets of atomized coating composition which are no longer supported by the air current of reduced velocity, converging wall means for producing an acceleration of the velocity of the air current with the atomized coating composition, and at least one application opening.

In a suitable form of the station according to the invention, the outlet opening has a slotlike form and is located closely to and transversely of the travelling support.

BRIEF DESCRIPTION OF THE DRAWINGS

The invention will be described hereinafter by way of example with reference to the accompanying drawings, wherein.

DETAILED DESCRIPTION OF THE INVENTION

Figure 1:
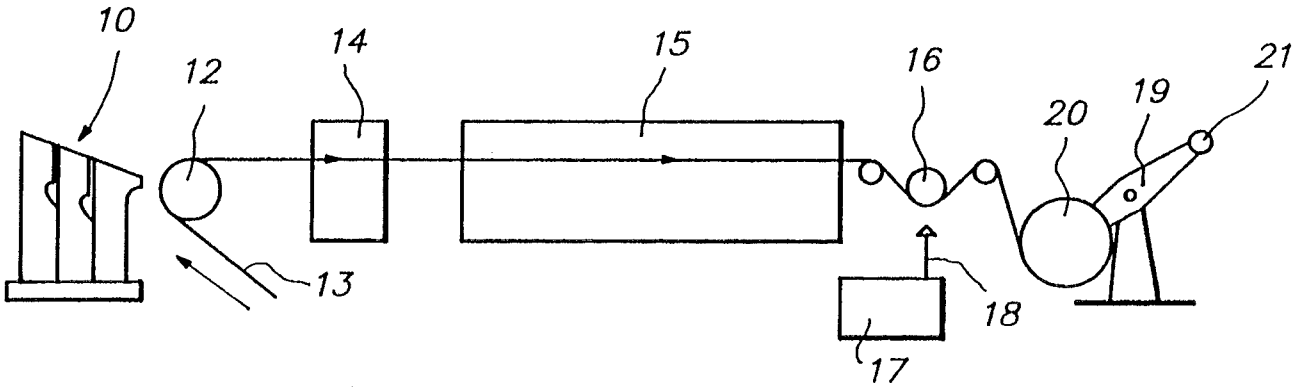
FIG. 1 is a diagrammatic illustration of one embodiment of a two-layer coater and FIG. 2 is a diagrammatic view of one embodiment of a station for the spray-coating of an additive on the already coated support in the installation of FIG. 1.

FIG. 1 shows diagrammatically a coating installation including a two-layer slide hopper coater 10, a backing roller 12 for supporting a support in the form of a web 13 in front of the coater, a chilling station 14 for solidification of the freshly applied coatings, a drying station 15 for the complete drying of the coated layers, a second backing roller 16 for supporting the web in front of a spray-coater illustrated diagrammatically by the block 17, the arrow 18 representing a cloud of a sprayed additive and a turret winder 19 for winding the sprayed web, a roll 20 being almost completed whereas 21 is an empty core.

In practice, the coating installation comprises much more expedients as there are web steering and web tension controlling means, splicing-means for connecting a fresh web to the old web as the roll with the web 13 being unwound has come to an end, means for controlling the temperature and moisture in the chilling and drying stations, fault detection devices for scanning the coated web for coating and other defects, etc. All these measures belong to the state of the art and since they are not necessary for understanding the present invention, they are not further described.

Figure 2:
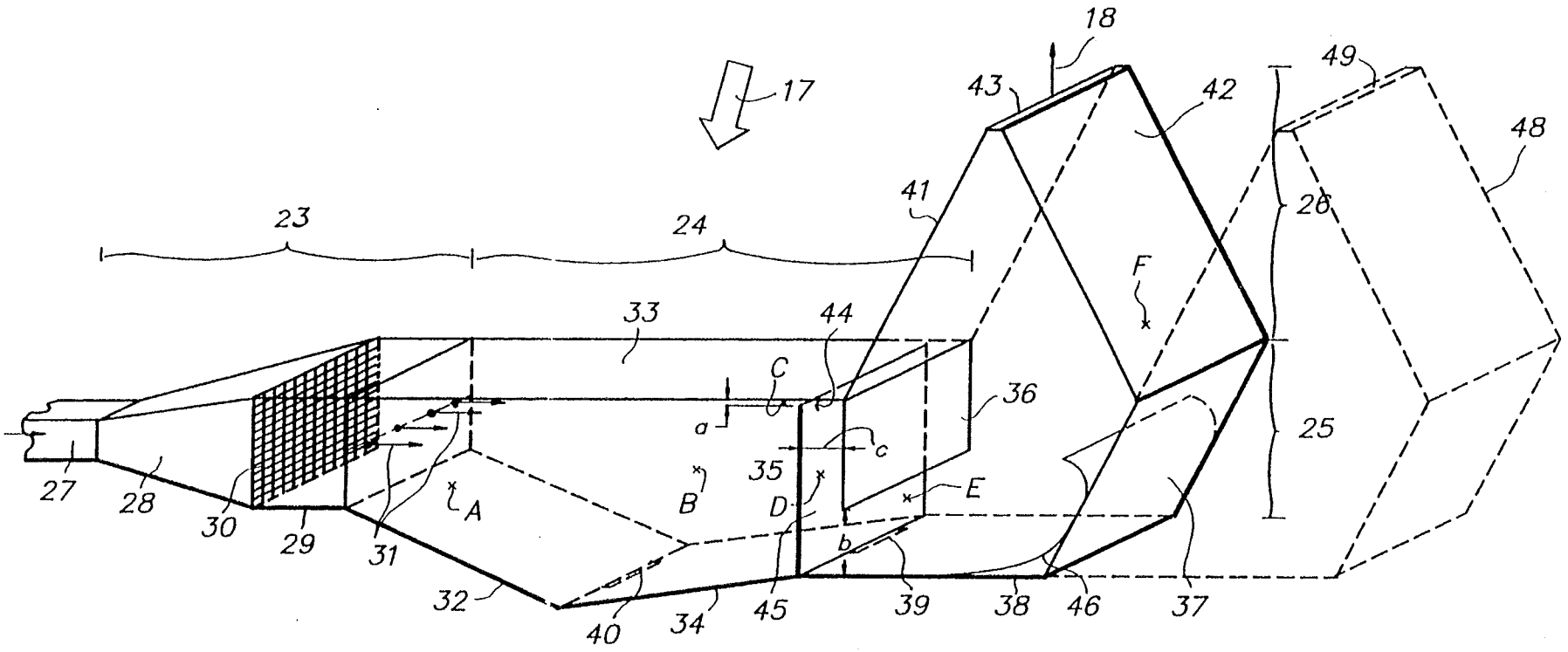

FIG. 2 is a detailed view of the spray coating device used in the installation of FIG. 1.

The device 17 has generally the form of a lying L-like chamber with a rectangular cross-section, comprising an inlet section 23, a first homogenizing and decelerating section 24, a second homogenizing and decelerating section 25 and an accelerating section 26.

The inlet section 23 comprises an inlet conduit 27, a widening conduit 28 and a conduit section 29 having at its entry a mesh 30 for homogenizing the entry air, and at its outlet four horizontally arranged airjet nozzles 31. The inlet conduit 27 is connected to an air blower. The airjet nozzles are of a type in which pressurized liquid is fed through a small opening and becomes atomized by airjets issuing from openings located around the liquid opening.

The section 24 is formed by two parallel lateral walls, a straight top wall 33 and two bottom walls, the first bottom wall 32 being downwardly inclined and the second bottom wall 34 being slightly upwardly inclined, according to the direction of advance of the air. Between the two bottom walls there is a slotlike opening 40 operating as a liquid drain as explained hereinafter.

The end of section 24 comprises a labyrinth formed by a vertical wall 35 erected from the bottom and a parallel vertical wall 36 descending from the top. The height of the opening 44 left by the wall 35 is indicated by a, the one left by wall 36 by b and the spacing between both walls by c.

The section 25 has parallel lateral walls, an inclined end wall 37 and a bottom wall 38 very slightly inclined thereby to conduct collected liquid to a slotlike discharge opening 39. A concavely curved deflector plate 46 runs from the bottom wall 38 to the end wall 37.

The accelerating section 26 has two parallel lateral walls and converging front and end walls 41 and 42 defining a horizontal slotlike outlet opening 43.

In operation of the device, the additive to be applied to the coated support is atomized through the airjet nozzles 31.

The air flow entering the device through opening 27 becomes loaded with atomized additive particles and carries them to the outlet of the section 24. Following the increasing cross-section of the first half of this section and the presence of the end wall 35, the velocity of the air mixture is progressively decreased towards the end of the section. At the same time the wall 35, and the slightly upwardly inclined bottom wall 34 cause turbulences in the air current which produce a good homogenization of the four atomized liquid cones produced by the airjet nozzles 31.

The atomizing of the additive by the airjet nozzles 31 produces fine droplets, the particle size of which may vary over a wide range, e.g. from 5.0 to 100 μm. The section 24 is operative to separate the larger particles from the remaining current since the decelerated air current is not capable of supporting such larger droplets. The separated droplets are collected at the bottom of the section and carried off through the slot 40 connected to a suitable liquid draining system, not illustrated.

The remaining finer droplets undergo an acceleration at the outlet of the section because of their passage through the outlet port 44 with a reduced section between walls 33 and 35.

The labyrinthlike passage 45 between the walls 35 and 36 represents a further resistance for the flow of atomized additive or additives, so that their velocity is again decreased.

Following the reduced velocity of the flow of additives another range of relatively large atomized particles can no longer be supported by the air current so that they go to the bottom where they are carried off through the slot 39.

Then the air flow enters section 25 through the port determined by wall 36 and bottom wall 38 and becomes strongly deflected over almost 180 degrees by the curved deflector plate 46. Once again, an intensive homogenization occurs by the turbulence induced in the air flow.

As the air flow enters the section 26, it is strongly accelerated because of the converging walls 41 and 42 leading to the applicator opening 43. The air loaded with atomized particles issues as an upward sheet from the device in the direction indicated by arrow 18 and then strikes the web in contact with the backing roller 16. The amount of additive in the air flow is so small that the additive liquid is so to say instantly taken up by the already coated gelatin layer(s) on the web, so that no extra drying is required and the web may be wound up to a roll 20 without further delay.

The following data illustrate the described spray-coating installation:

Dimensions:
- Section 24:
  - length: 1300 mm
  - width : 250 mm
  - max. height: 600 mm
- Labyrinth 45:
  - a: 35 mm
  - b: 200 mm
  - c: 100 mm
- Height of section 25: 600 mm
- Height of section 26: 600 mm
- Width of outlet opening 43: 15 mm
- Rate of air blower through channel 27: 540 m3/h/cm width
- Rate of additive sprayed by each airjet 31: 20 cc/min
- Rate of pressurized air used for each air jet 31: 4 m3/h
- Airjets: type flat spray E15B made by Spraying Systems Co., North Avenue, Wheaton, Ill. 60188 U.S.A.

Air Velocities:
- At point A: 9 m/s
- At point B: 2 m/s
- At point C: 4.5 m/s
- At point D: 1.5 m/s
- At point E: 0.75 m/s
- At point F: 0.25 m/s
- At outlet 43: 10.0 m/s Particle Size Distribution
- At the outlet of the airjets: between 5 and 100 μm
- At the outlet 43 : between 5 and 40 μm The following examples illustrates the operation of the described spray-coater of FIG. 2 in the installation of FIG. 1.

EXAMPLE 1

Polyoxyethylene dodecyl ether (1 wt % aqueous solution) was used as an antistatic agent and sprayed at a temperature of 20° C. at the rate as described hereinabove. The distance between the application opening 43 and the roller 16 amounted to 1 cm. The atomized additive which has not been applied to the web is sucked off by appropriate conduits disposed at both lateral sides of the web and may be conveyed to a recovery tank for recovery of the additive. The web was in the present example a suitably subbed polyester support coated with coater 10 with a radiographic emulsion layer and an anti-stress layer on top of it. The film was completely dry at the exit of the drying chamber 15 as this was the chamber used in the normal production of the film. The additive was coated at a rate of 0.5 cc/m2 what resulted in a surface resistivity of $10^{12}$ Ohm/sq.

Furthermore, it was shown that by appropriate adjustment of the rate of additive, the surface resistivity could easily be adjusted in a range of approximately $10^{13}$ to $10^{10}$ Ohm/sq. The distribution of size particles of the droplets remained well within the mentioned range, so that under no circumstances droplets became deposited on the web, the size of which is such that the emulsion layer doesn't absorb them before the web was wound, as this would cause unrepairable damages of the material.

The described web was then unwound again and the same operations of layer coating and spray-coating of the surfactant were repeated at the opposite side, thereby producing a conventional two-side coated radiographic film.

EXAMPLE 2

This example relates to a polyethylene terephthalate film support carrying superposed thereon in succession, a subbing layer (A) which is directly adherant to said support and comprises a copolymer formed from 45 to 99.5% by weight of at least one of the chlorine-containing monomers vinylidene chloride and vinyl chloride, from 0.5 to 10% by weight of an ethylenically unsaturated hydrophilic monomer, and from 0 to 54.5% by weight of at least one other copolymerisable ethylenically unsaturated monomer; and a subbing layer (B) comprising in a ratio of 1:3 to 1:0.5 by weight of a mixture of gelatin and a copolymer of 30 to 70% by weight of butadiene with at least one copolymerisable ethylenically unsaturated monomer.

In practice, layer (A) is coated to the film support and also dried between the longitudinal and transverse heat-stretching step of the film. Both said heat-stretching operations are done in succession in order to increase the physical characteristics of the film, notably the Young's modulus, and also to reduce the thickness of the film. The film is then transversely stretched to improve its characteristics similarly in the transverse direction. Information about a suitable process for the biaxial stretching of a polyethylene terephthalate film is disclosed in U.S. Pat. No. 4,293,508. It is clear that the dry layer thickness of layer (A) is reduced by an amount equalling the transverse stretching factor. Layer (B) is coated on the film after the transverse stretching. The mentioned process is disclosed in U.S. Pat. No. 3,649,336.

Layer (B) raises no problems in practice since its solids contents is high.

Layer (A), on the contrary, is coated in practice with a wet layer thickness of approximately 10 μm and requires the use of a drier between the coating installation and the transverse stretcher in order to ensure that the coated layer is dry upon entereing the transverse stretcher.

In accordance wit the present example, the coater for applying layer (A) was put out of service in the installation and instead layer (A) was applied to the support after the transverse stretching by means of a spray-coater in accordance with the present invention. The wet layer thickness amounted to 1 μm.

This small layer thickness can be quickly dried by means of a IR-heater and immediately thereafter layer (B) can be coated.

EXAMPLE 3

This example relates to colour negative cinefilm of the type AGFA XT125 and XT320 which shows a wide exposure latitude, high definition, excellent grain characteristics and natural skin tones, and which is being marketed by AGFA-GEVAERT N.V., Mortsel, Belgium.

The film is provided with a hardened top layer that has for function to protect the underlying image-sensitive layers. In current practice, this top layer is coated by means of a slide hopper coater at a wet layer thickness of 48 μm. The dry layer thickness amounted to 0.2 μm. The coating composition consists of a mixture of 83% of an aqueous gelatin solution of 0.8% concentration by weight, and 17% of a 8% by weight concentration of the following hardening agent : -2-(morpholinocarbonyl )-4-pyridinio-(ethane) sulphonate. This hardening agent is in practice mixed with the gelatinous solution just prior to the feeding to the coating hopper in order to avoid undesirable precipitation effects in the coater.

In accordance with the present example, the hardening layer was no longer coated by means of a slide hopper coater but instead by means of a spray-coater according to the invention which coated a wet layer thickness of the described composition on the film of slightly more than 1 μm wet layer thickness with a solids content of 50%.

EXAMPLE 4

This example relates to photographic light-sensitive film for use in the AGFASTAR (trademark of Agfa-Gevaert AG, Leverkusen, Germany) lith system with rapid access and ease of processing. AGFASTAR is a hard dot system that combines lith quality and line facility. In other words: dots with lith quality and rapid access ease of processing.

This film was coated by means of a common two-layer slide hopper, the lower layer being a light-sensitive layer and the upper layer being a mixture of a gelatinous antistress composition, and a hardening agent of the type as described in example 3 hereinbefore. The mixture containing 84% by weight of the 0.8% solution of gelatin and 16% by weight of an 8% hardening agent concentration. It was shown that the fast reacting hardener caused problems in the slide hopper coater after a few hours already so that the coating operation had to be stopped for cleaning the coater.

A modified coating procedure was established by replacing the original top layer by a pure gelatinous antistress layer, and then passing the coated film after its drying and winding a second time through a coating installation for slide hopper coating a layer containing the hardening agent described hereinbefore on top of the antistress layer.

It will be understood that this procedure is expensive. Therefore, in accordance with the invention, the second slide hopper coating was substituted by spray-coating the hardening agent on-line with the first coating, at a wet layer thickness of 1 μm, a viscosity of 1 mPas, and a concentration of 40% by weight.

EXAMPLE 5

This example relates to a presensitized plate for use in making a planographic printing plate, comprising an aluminum plate having an anodized film layer, a hydrophilic layer provided on said anodized film layer and a lithographically suitable light-sensitive layer on said hydrophilic layer, said hydrophilic layer comprising a hydrophilic compound having at least one amino group and at least one group selected from the class consisting of a carboxyl group in the free acid form or salt form, a sulfo group in the free acid form or salt form, and a hydroxyl group. The plate has a prolonged life on the printing press and at the same time is resistant to scumming on non-image areas.

The structure of this plate and its use is disclosed in U.S. Pat. No. 4,801,527.

The described plate can be manufactured by coating the different layers directly on an aluminum support, e.g. in the form of a composite layer by means of a multislot slide hopper coater. However, it has also been proposed to coat said layers in reverse order on a temporary support, e.g. on a polyethylene terephthalate support, and next to laminate said layers from said temporary support onto the aluminum support. The top layer on the temporary support is a layer containing silver nuclei for forming the final image. This technique is disclosed in U.S. Pat. No. 4,801,527.

The coating of said nuclei occurred originally at a wet layer thickness of 4 μm by means of a reverse roller coater, but was in accordance with the present example replaced by a spray coater at a wet layer thickness of 1 μm and a viscosity of 1 mPas.

The invention is not limited to the embodiment described hereinbefore.

The application of the coating composition to the support can be improved or facilitated by using an electrostatic field in the air gap between the outlet opening 43 and the opposed area of the web 13. According to one arrangement, the backing roller may be mounted electrically insulated from the ground and connected to a source of high voltage and the control station for the atomized current is electrically grounded. The electric safety of the installation may be improved by using an electrically insulating backing roller except for an electrically conductive medial circumferential portion connected with the source of high voltage through appropriate contact means. According to a preferred embodiment, the circumferential portion is a conductive mantle being a flush with insulating end sections of the roller, so that the end sections form a protection against accidental touching of the high tension part of the roller by an operator.

The uniformity of coating can be improved by providing additional applicator openings to the opening 43. One embodiment of another applicator opening is shown in broken lines in FIG. 2 as the housing 48 having at the top an applicator opening 49. The wall 37 should be considered as non-existent so that the housing 48 is in communication with the one shown in drawn lines. The distance between the applicator openings 18 and 49 may be ranged for instance between 1 and 10 cm. It is clear that web conveying rollers should be appropriately adjusted to carry the web at the correct postion past the two applicator openings.

The uniformity of coating can be further improved by the provision of converging wall means that further increase the turbulence of the carrying air current in the installation and thus intensify the homogenization of the mixture. One suitable place for suchlike wall means is in the section 29, downstream or upstream of the position of the nozzles 31. Such wall means can be in the form of adjustable panels offering maximum opportunity for obtaining a good uniformity of the coating current at the applicator opening 18, and/or 49.

A spray-coating station according to the invention must not necessarily have an L-like shape as illustrated, but may also take other shapes, e.g. a U-like shape. In such case the section 23 could be oriented vertically, in parallel with sections 25 and 26. The deflection of the carrying air current in the cross-over from such vertical section 23 towards the horizontal one 24 can further improve the homogenization of the air current.

We claim:

1. A coating station for coating a thin layer of coating composition on a web in the production of a photographic material, said station comprising a housing having a first section with an inlet connected to a source of pressurized air and being provided with a plurality of air jet nozzles for the coating composition arranged in a row running parallel to the path of the web, said first section further having parallel side walls and mutually diverging upper and lower wall means defining a space with a rectangular cross-section operative to decrease the velocity of the air current loaded with atomized coating composition, parallel side walls and converging upper and lower wall means causing an homogenizing of said loaded air current, and a first elongate outlet port causing an acceleration of said air current, a second section also having parallel side walls and transverse wall means that first diverge and next converge to cause corresponding deceleration and homogenizing of said loaded air current, a third section located between said first and second sections, which further reduces the velocity of said air current leaving said first outlet port, said third section having vertical front and rear walls for directing said air current vertically downwardly and a second elongate outlet port causing re-acceleration of said air current and application thereof onto said web.

2. A coating station according to claim 1, wherein the inlet is provided with a mesh for homogenizing the entry air.

3. A coating station according to claim 1, further including means to control the velocity of said air current so that it is decreased to at most 0.25 m/s.

4. A coating station according to claim 1, further including means to control the velocity of said air current so that it is increased to at least 10 m/s as it leaves the second outlet port.

5. A coating station according to claim 1, which has discharge openings for carrying off atomized droplets being no longer supported by the air.

* * * * *